US006164858A

United States Patent [19]

Kaufmann

[11] Patent Number: 6,164,858

[45] Date of Patent: Dec. 26, 2000

[54] FLUID REGULATOR FOR SUPPLYING A CONSUMER ELEMENT WITH FLUID FROM A FLUID RESERVOIR

[75] Inventor: Rainer Kaufmann, Delmenhorst, Germany

[73] Assignee: Dataprint R. Kaufmann KG (GmbH & Co.)

[21] Appl. No.: 09/380,058

[22] PCT Filed: Feb. 6, 1998

[86] PCT No.: PCT/EP98/00663

§ 371 Date: Aug. 20, 1999

§ 102(e) Date: Aug. 20, 1999

[87] PCT Pub. No.: WO98/36918

PCT Pub. Date: Aug. 27, 1998

[30] Foreign Application Priority Data

Feb. 21, 1997 [DE] Germany ..... 197 06 967

[51] Int. Cl.[7] ..... B43K 5/00

[52] U.S. Cl. ..... 401/205; 401/178

[58] Field of Search ..... 401/198, 199, 401/205, 223, 196, 222, 206

[56] References Cited

U.S. PATENT DOCUMENTS

| | | | |
|---|---|---|---|
| 2,392,840 | 1/1946 | De Groft | 401/198 |
| 3,972,629 | 8/1976 | Whalen, Jr. . | |
| 4,065,215 | 12/1977 | Otsuka | 401/199 |
| 4,973,180 | 11/1990 | Hori | 401/205 |
| 5,290,116 | 3/1994 | Chang | 401/205 |
| 5,735,624 | 4/1998 | O'Connor | 401/205 |

FOREIGN PATENT DOCUMENTS 0 240 994 10/1987 Germany .

*Primary Examiner*—David J. Walczak
*Attorney, Agent, or Firm*—Robert W. Becker & Associates

[57] ABSTRACT

A device or fluid regulator controls the supply of fluid to a consumer element from a fluid reservoir. A fluid supply line leads from the fluid reservoir to the consumer element. A valve is disposed in the fluid supply line. The valve element of the valve automatically opens the valve opening whenever downstream of the valve the consumer element has consumed a predetermined quantity of fluid. The valve is embodied as a capillary valve and downstream of the valve opening contains a capillary space that is connected to the fluid supply line, the capillary space being partially delimited by the valve element, which closes off the valve opening by the capillary force imparted by the fluid in the capillary space when the capillary space is filled with a predetermined amount of fluid.

12 Claims, 3 Drawing Sheets

FLUID REGULATOR FOR SUPPLYING A CONSUMER ELEMENT WITH FLUID FROM A FLUID RESERVOIR

BACKGROUND OF THE INVENTION

The present invention relates to a fluid regulator for supplying a consumer element with fluid from a fluid reservoir and containing a valve for establishing communication between the fluid reservoir and the consumer element when the consumer element has consumed a predetermined quantity of fluid. The fluid consumer elements can, for example, be tips or nibs for writing, painting, and brush devices or also application and discharge elements of fluid dispensers.

With heretofore known writing instruments, such as fountain pens, the supply of ink to the writing tips is effected by capillaries that by means of their capillary force draw ink out of a reservoir, whereby a pressure relief opening in the reservoir is dimensioned such that only after a partial vacuum drops below a certain value is the removed ink replaced with air. In this connection, the partial vacuum in the reservoir suffices to prevent ink from running out despite its weight. These ink supply systems have the characteristic that when a temperature change of the ambient air occurs they are no longer discharge reliable, since the air in the reservoir expands and thus reduces the partial vacuum that prevents the discharge. Measures for preventing such a discharge of ink by means of additional capillary buffer storage means for the temporary accommodation of an excess volume of ink are complicated and expensive and are effective to only a limited extent.

EP 0 240 994 B1 discloses a device of the aforementioned general type, the valve of which is disposed between a fluid reservoir and an intermediate reservoir from which the consumer element is supplied with fluid via a capillary line. If the intermediate reservoir is increasingly emptied as the fluid is consumed, there results at that location a partial pressure so that the valve, one side of which borders the fluid reservoir and the other side of which borders the intermediate reservoir, opens and the intermediate reservoir is again filled with fluid. A characteristic of this system is that it can lead to permanent disruption of the fluid supply if the partial vacuum is adjusted in another manner.

It is an object of the present invention to provide a device of the aforementioned type that ensures a functionally reliable supply of a consumer element with fluid with a simple construction.

SUMMARY OF THE INVENTION

This objective is realized in that the valve contains a capillary space, the capillary force of which displaces the valve element of the valve into a position that closes the valve opening of the valve when the capillary space fills itself entirely or partially with fluid from the fluid reservoir.

The inventive capillary regulator, the construction of which can be extraordinarily simple, operates in an extremely functionally reliable manner due to the high forces that occur in capillary systems, and ensures a high flow or discharge reliability of the consumer element supplied thereby.

Having the capillary space connected to the consumer element via a line, the capillarity of which is greater than that of the capillary space, or having the consumer element capillary, with its capillarity greater than that of the capillary space, ensure that the fluid supply line or the consumer element, downstream of the capillary space, reliably, constantly, fully draw in fluid.

Pursuant to further advantageous features of the capillary valve, the capillary space can on the whole be disc-shaped, whereby the valve opening is embodied in one end face and the other end face is formed by the valve element. The valve element can have an elastic diaphragm, which can have a particularly high reliability if it is reinforced by a reinforcing plate. The valve element could also have a ball for closing off the valve opening.

The pressure acting from the fluid supply column can be used directly as the valve opening force.

If the fluid reservoir is contained in a pouch, the discharge reliability is further increased since the venting of the interior of the elastic pouch is not necessary.

Pursuant to toward two advantageous examples of applications of the inventive device the consumer element can be the capillary writing tip of a drawing instrument, or the consumer element can be the printing unit of a printing device.

BRIEF DESCRIPTION OF THE DRAWINGS

The present invention will be explained by way of example and in further detail subsequently with the aid of schematic drawings.

Illustrated are.

DESCRIPTION OF PREFERRED EMBODIMENTS

Figure 1:
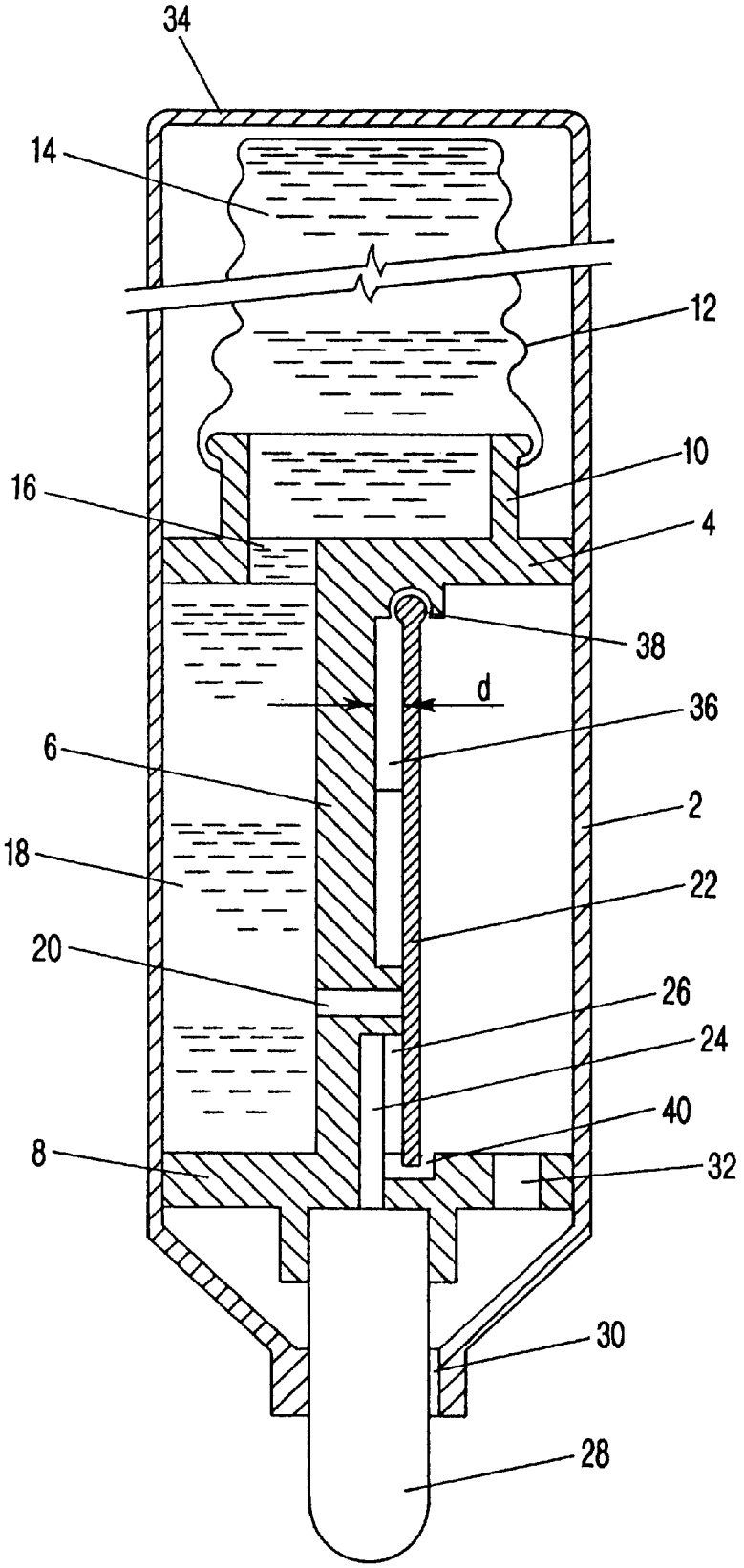
FIG. 1. a cross-sectional view through a felt-tipped pen equipped with the inventive fluid regulator, FIG. 2. an enlarged view of the capillary regulator contained in FIG. 1, FIG. 3. a view of the valve element of the capillary regulator of FIG. 2, and FIG. 4 a schematic cross-sectional view of a printing device provided with the inventive device, FIG. 5 a detailed view of an embodiment modified from that shown in FIG. 1.

Pursuant to FIG. 1, a felt-tipped pen has a casing 2, the interior of which is subdivided into various chambers by partitions 4, 6, and 8. The partition 4 is provided with an annular flange 10 upon which is placed a flexible or elastic bag or pouch 12 that contains a fluid or liquid reservoir 14, whereby the fluid can be any known writing fluid, such as ink. An opening or aperture 16 leads through the partition 4 into a line 18, from which a valve opening 20 leads through the partition 6. Resting against that end face of the valve opening 20 that is remote from the line 18 is a valve element 22, whereby the distance "d" between the valve element 22 and the partition 6 has capillary dimensions as will be explained subsequently.

The line 18 can be filled with material that dampens the throughflow so that pressure waves from the fluid reservoir 14 have no effect upon the valve functions.

Pursuant to FIG. 1, formed below the valve opening 20 in the partition 6 is a line 24, the diameter of which is advantageously less than the distance "d" and that opens via a connecting opening 26 into the space between the partition 6 and the valve element 22. The line 24 leads to a capillary writing tip or nib 28 that is of conventional construction and is of a type used for felt-tip pens. The writing tip 28 is disposed in a flange of the partition 8, with the forward region of the tip additionally being held by a conically extending part of the casing 2.

The writing tip 28 can also project directly into the space between the valve element 22 and the partition 6.

Pressure relief openings 30, 32, and 34 take care of venting the interior of the casing 2.

The overall plate-like valve element 22, which between itself and the partition 6 delimits a plate or disk-shaped capillary space 36 having a thickness "d", is pivotably connected with the partition 4 as indicated at the reference numeral 38 and projects into a recess 40 of the partition 8 that forms an opening delimitation for the valve element 22. Instead of a pivotable connection, an elastic connection can also be provided.

Prior to explaining the function of the described device, several physical principles are briefly noted:

With the valve element 22 that closes off the valve opening 20, via the valve opening 20 and via the fluid column that is present on the left side of the valve opening 20, the following force acts upon the valve element 22:

$$K=\pi\times r^2\times h\times a$$

whereby r: radius of the valve opening h: height of the fluid column a: specific weight of the fluid If the valve element 22, on that side facing the capillary space 36, and the partition 6, on that side facing the capillary space 36, are made of a material that is wetted by the fluid, the fluid will be drawn into the capillary space 36 as a consequence of the capillary attraction and under circumstances additionally due to the hydrostatic pressure of the fluid column, will be pressed into the capillary space 36. Due to the fluid in the capillary space, this leads to the valve element 22 being drawn in a closing direction, i.e. in abutment against the edge of the valve opening 20, with the following force:

$$K_s=2\times o\times f/d$$

whereby o: surface tension of the fluid, d: thickness of the capillary space 36, and f: surface of the valve element 22 wetted by fluid.

Usual dimensions are in the following ranges:

d: 0.01 to 1 mm f: 1 $mm^2$ to several $cm^2$ h: 1 cm to 1 m r: 0.01 to 5 mm o: 10 to $70\times10^{-2}$ N/m With d: 0.1 mm, $o=50\times10^{-2}$ N/m, f=1 $cm^2$, there results: $K_2=0.1N$.

With r=0.2 mm, h=5 cm, $a=10^4 N/m^3$ there results: $K=6\times10^{-5}$ N.

Thus, the opening force exerted by the height of the fluid column amounts to only a fraction of the closing force, as a consequence of which the valve is closed extremely reliably and when impact movements occur there is no danger of opening as long as the mass of the valve element 22 is small.

The function of the described felt-tip pen is as follows:

It is assumed that the felt-tip pen is in the state shown in FIG. 1, i.e., the valve element 22 closes the valve opening 20, since the capillary space 36 is adequately filled with fluid. If the felt-tip pen is now used to write and fluid is delivered from the writing tip 28 the capillary space 36 is increasingly emptied. The closing force of the valve element 22 thereby decreases, so that when the capillary space is sufficiently emptied, the fluid pressure and/or a shaking movement opens the valve element 22, whereupon the capillary space again fills with fluid due to the hydrostatic pressure and also the capillarity, and the valve element 22 again closes the opening 20. The process begins anew. It is advantageous for the line 24 to have a greater capillarity than does the capillary space 36, since this ensures that the line 24 "sucks" the capillary space "empty".

It is to be understood that the described device can be modified in a number of ways. The way the interior of the casing is subdivided can vary; the writing tip can be different; the arrangement of the venting openings can be modified; in the region of the pouch 12 the casing can be adapted to be opened so that the pouch can easily be replaced. Even if the entire device has been completely used up, it is automatically reliably completely filled with ink after a new pouch is installed without there being any danger of contamination or clogging.

Figure 2:
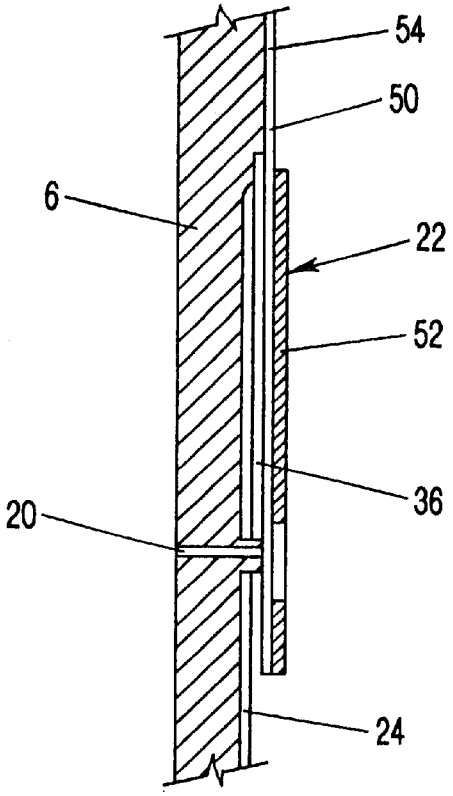
Figure 3:
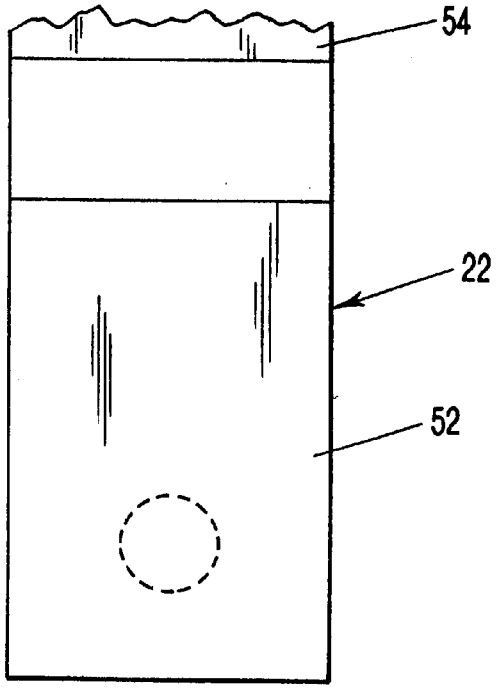

FIGS. 2 and 3 show a modified construction of a valve. In this embodiment the valve element 22 is an elastic membrane or diaphragm 50 that is reinforced by a reinforcing plate 52. In its upper region 54, the elastic diaphragm 50 is rigidly connected with the partition 6, so that between the region 54, which is rigidly connected, for example, by gluing, and the region reinforced by the reinforcing plate 52, a region remains that forms a flexible joint of the valve element 22. The capillary space 36 is defined by an appropriately deep recess in the partition 6, whereby that end face of the valve opening 20 that faces the valve element 22 projects by the thickness or depth of the capillary space. With this construction of the valve element 22, a particularly high functional reliability is achieved with a simple construction.

Figure 4:
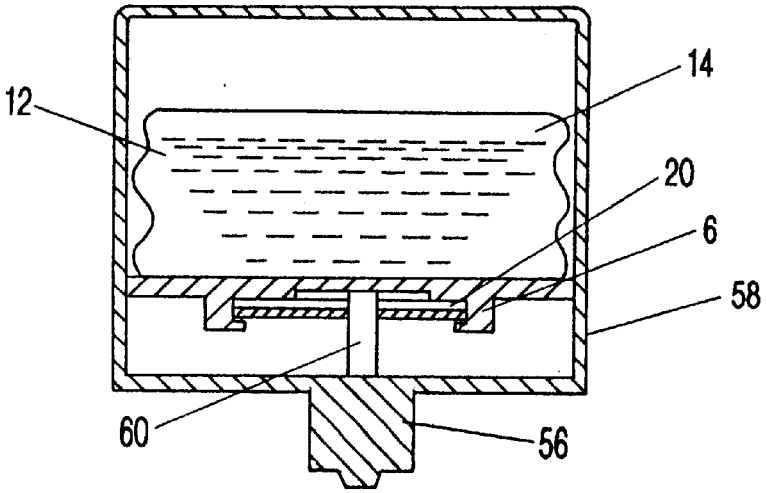

FIG. 4 shows the construction of FIG. 1 and FIG. 2 schematically in its use with a printing unit 56 of a printing device 58, for example as used in ink jet printers. Here the fluid reservoir 14 directly borders on the partition 6 with the valve opening 20. The writing tip 28 (FIG. 1) corresponds to a capillary wick 60 that supplies the printing unit 56 with fluid.

Figure 5:
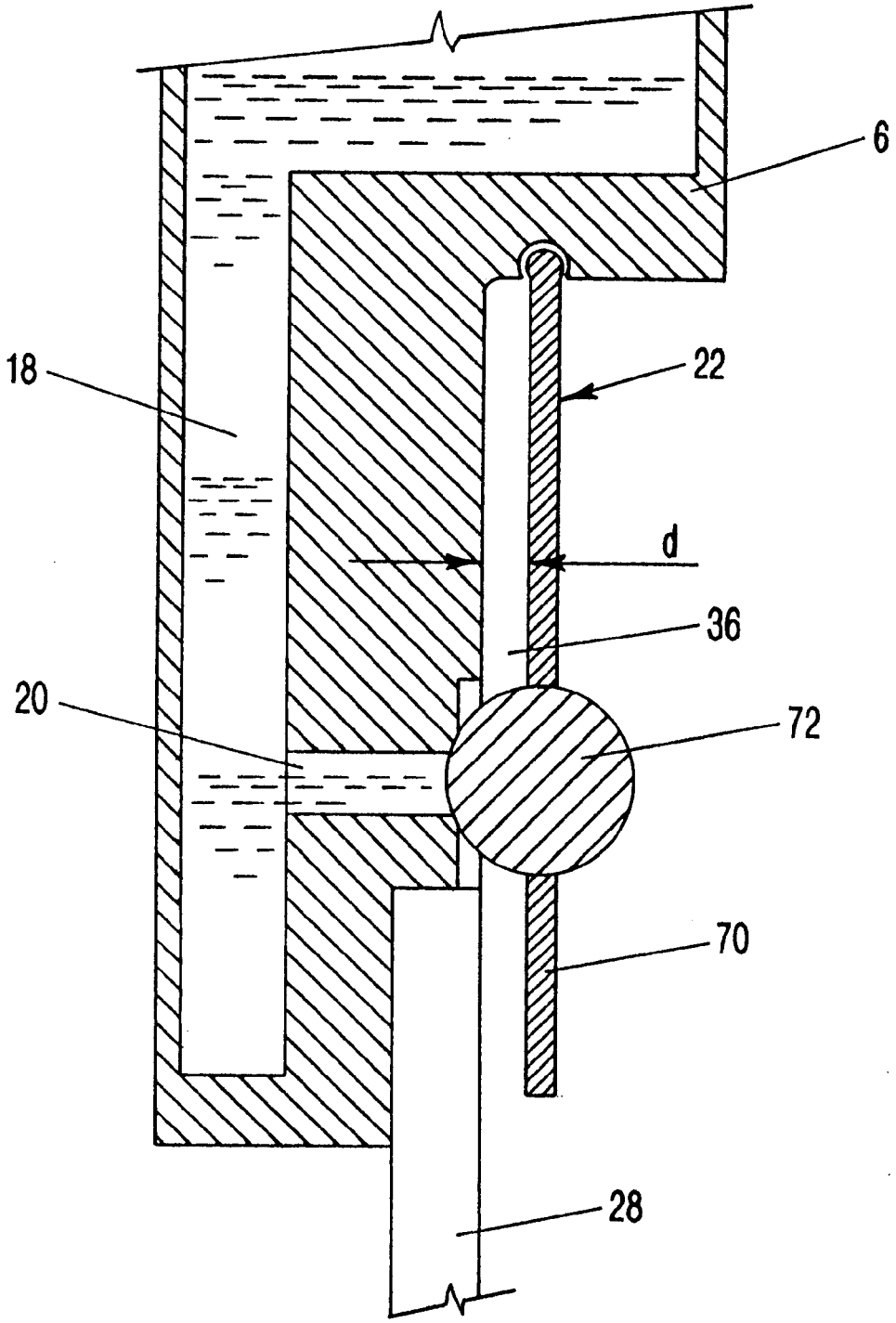

FIG. 5 shows an embodiment of the inventive regulator that is modified relative to the embodiment of FIG. 1: the valve element 22 is here embodied as a plate 70 that is pivotably mounted on the partition 6 and has an opening in which a ball 72 is secured. The ball 72 can also be monolithically formed with the plate 70, for example by injection molding. By means of the ball 72, which should be made of as light a material as possible, the closing reliability of the valve 20,22 is improved and its sensitivity to contamination is reduced. A further difference from the embodiment of FIG. 1 is that the consumer element, which is here also embodied as a capillary writing tip 28, directly borders on the capillary space 36, which simplifies construction and increases the functional reliability, especially since the capillarity of the writing tip 28 is greater than that of the capillary space 36. In other respects, the function is the same as described in conjunction with the embodiment of FIG. 1.

The present invention is, of course, in no way restricted to the specific disclosure of the specification and drawings, but also encompasses any modifications within the scope of the appended claims.

What is claimed is:

1. A fluid regulator for supplying a consumer element with fluid from a fluid reservoir, comprising:

a valve 20, 22 for establishing communication between said fluid reservoir 14 and said consumer element 28; 60, 56 when said consumer element has consumed a predetermined quantity of fluid, wherein said valve contains a capillary space 36, a capillary force of which displaces a valve element 22 of said valve into a position that closes off a valve opening 20 of said valve when said capillary space 36 fills itself at least partially with fluid from said fluid reservoir 14.

2. A fluid regulator according to claim 1, which includes a line 24 that connects said capillary space 36 to said consumer element 28; 60, 56, wherein the capillarity of said line 24 is greater than that of said capillary space 36.

3. A fluid regulator according to claim 1, wherein said consumer element 28; 60, 56 is capillary and has a capillarity that is greater than that of said capillary space 36.

4. A fluid regulator according to claim 1, wherein said capillary space is substantially disc-shaped, with said valve opening defined in one end face thereof and a second end face defined by said valve element.

5. A fluid regulator according to claim 1, wherein said valve element 22 is provided with an elastic diaphragm 50.

6. A fluid regulator according to claim 5, which includes a reinforcing plate 52 for reinforcing said elastic diaphragm 50.

7. A fluid regulator according to claim 1, wherein said valve element 22 is provided with a ball 72 for closing off said valve opening 20.

8. A fluid regulator according to claim 1, which includes means for closing said valve against the pressure of a fluid column that acts from said fluid reservoir 14 upon said valve opening 20.

9. A fluid regulator according to claim 1, which includes a pouch 12 in which is contained said fluid reservoir 14.

10. A fluid regulator according to claim 1, wherein said consumer element is a capillary writing tip 28 of a drawing instrument.

11. A fluid regulator according to claim 1, wherein said consumer element is a printing unit 56 of a printing device 58.

12. A fluid regulator for supplying a consumer element with fluid from a fluid reservoir, comprising a valve for establishing communication between said fluid reservoir and said consumer element when said consumer element has consumed a predetermined quantity of fluid, said valve comprising a valve element for opening and closing a valve opening between said fluid reservoir and said consumer element and further comprising a capillary space on a downstream side of said valve opening, said capillary space being in direct communication with the outer atmosphere and in fluid connection with said consumer element and being at least partially defined by said valve element as to apply a capillary force onto said valve element depending on the volume of fluid within said capillary space, so that said valve closes, when said capillary space fills itself at least partially with fluid from said fluid reservoir.

* * * * *